United States Patent [19]

Molitor

[11] Patent Number: 4,729,566

[45] Date of Patent: Mar. 8, 1988

[54] GAME BALL

[75] Inventor: Robert P. Molitor, Niles, Mich.

[73] Assignee: Spalding & Evenflo Companies, Inc., Tampa, Fla.

[21] Appl. No.: 876,506

[22] Filed: Jun. 20, 1986

[51] Int. Cl.[4] ..... A63B 37/12

[52] U.S. Cl. ..... 273/60 A; 264/239; 273/60 B; 273/65 EG

[58] Field of Search ..... 273/60 R, 60 A, 60 B, 273/65 EG, 58 A, 58 K

[56] References Cited

U.S. PATENT DOCUMENTS

| | | | |
|---|---|---|---|
| 1,543,724 | 6/1925 | Roberts et al. | 273/65 EG |
| 1,994,703 | 3/1935 | Hawes | 273/60 A |
| 2,213,479 | 9/1940 | Voit et al. | 273/60 R |
| 2,325,128 | 7/1943 | Grady | 273/65 EG |
| 2,653,818 | 9/1953 | Tebbetts | 273/65 EG |
| 4,000,894 | 1/1977 | Butzen | 273/65 EG |

*Primary Examiner*—George J. Marlo

*Attorney, Agent, or Firm*—Donald R. Bahr; John E. Benoit

[57] ABSTRACT

A two-piece softball or baseball includes a molded core and a molded cover including simulated stitching having protrusions and indentations integral with the cover material. Stitch holes adjacent the simulated stitching extend through the cover to the spherical core to simulate the depth of the stitching holes in a standard stitched leather covered ball.

1 Claim, 6 Drawing Figures

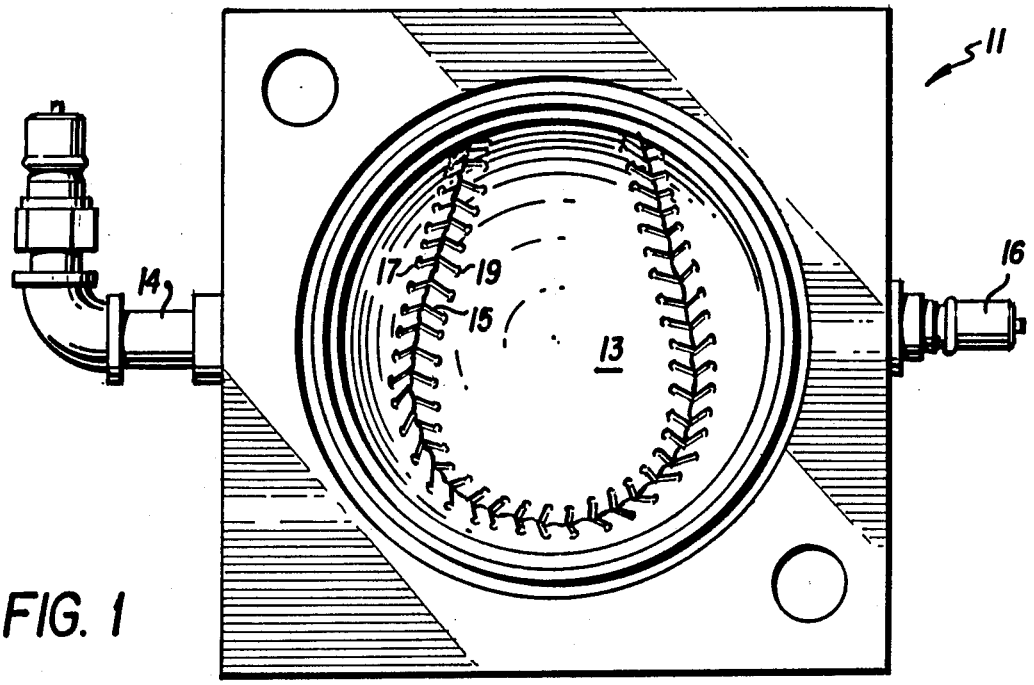
FIG. 1
FIG. 2
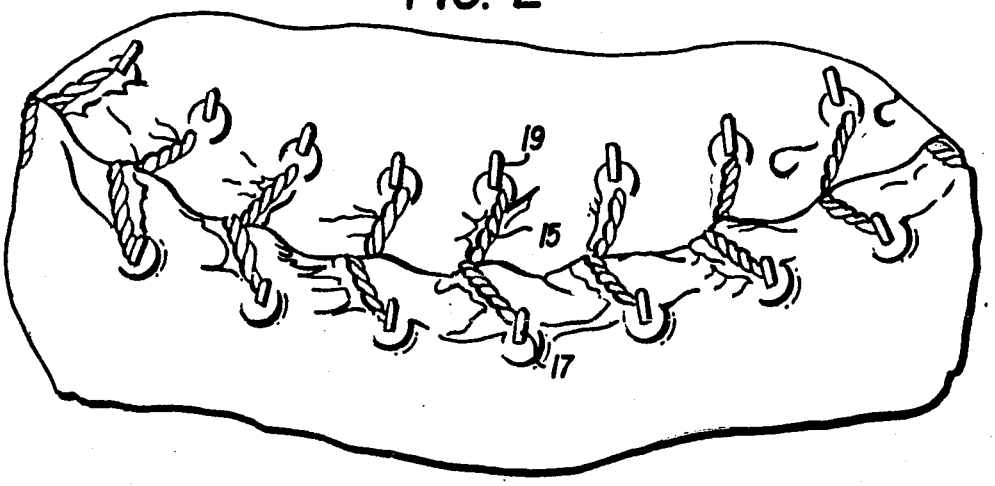

GAME BALL

This invention is directed to a mold for use in making a playing ball, the method of making the mold and the resultant ball.

BACKGROUND OF THE INVENTION

Playing balls of the type such as softball or baseball normally consist of a core and a leather cover with the cover having the standard FIG. 8 stitching associated therewith.

Proposals have been made to substitute a standard leather covered ball with balls having preselected cores and molded covers. One such proposal is set forth in U.S. Pat. No. 2,645,487 issued July 14, 1953 to E. H. Hawes. In that particular application, a spherical core, having a strand winding thereon, has bonded thereto a cover of latex which consists of an integrated unitary one-piece shell. The outer surface includes an embossment having a figure 8 series of stitch-like mounds arranged along a juncture-imitating line and also, within the weld itself, has depressions which are dot-like in order to similate needle holes which appear in the stitching of a standard ball. The resultant ball, while somewhat resembling a baseball, is clearly distinguishable over such a ball and does not render itself to competition which would require that the ball be very similar to and react similarly to a standard ball.

Another illustration of this type of ball is described in U.S. Pat. No. 2,938,237 issued May 31, 1960 to Kern et al. This patent discloses a method of covering a ball with a cover made from a liquid mixture of vinyl resin and plasticizer used for coating the surface of a cavity in a separable mold with a layer of the mixture, heating the layer to a tacky gel, splitting the layer into parts by opening the mold and placing a preformed core on the layer in the mold and closing the mold and applying heat to fuse the said layer parts together with the core. This proposed ball also contains an embossment similar to the stitching on a standard ball. It has no provision for attempting to show any stitch holes in the ball.

The present invention discloses a mold and the method of making the mold and the resultant molded softball or baseball having a cover of vinyl, urethane or other applicable polymers either by themselves or in mixtures or as alloys. The cover is such that it imparts leather-like feel, smell, if desired, and playability of a standard ball and, by its very nature, has superior durability. If desired, the ball may be molded as a one-piece unitary structure, although the two-part ball is preferred.

Through production of balls from the select master mold, and using these balls to make additional molds, the production product will have uniformity of size and surface configuration superior to any of the existing commercial products known to the present inventor. The detail and superior appearance of this ball is obtained primarily from the metal mold which is preferably an electro-formed nickel and/or copper mold. In order to faithfully reproduce the stitch holes of the leather covered product, nickel pins or the like are inserted in the ball master prior to plating. When the mold is complete, these nickel pins become an integral part of the mold.

As a result, balls which are produced in the mold, using a basic core and the material discussed above, have a feel and an appearance including the leather grain, the stitching and even the stitch holes so as to provide a substantially true simulation of a standard type of leather covered ball. The ball is superior to current commercial products. It is superior to leather covered balls in durability (no torn stitches, superior scuff resistance, moisture resistance, retention of shape during play, etc.) and uniformity in that ball variations in the leather product are extreme compared to a molded product. The ball is superior to existing molded products in duplicating the appearance and feel of the stitched leather product, unlike the conventional molded product which is obviously different.

The objects and advantages of this invention become apparent from the following description taken together with the drawings.

BRIEF DESCRIPTION OF THE DRAWINGS

FIG. 1 is an inner partial plan view of one half of a mold insert;

FIG. 2 is a partial view showing a magnified illustration of the stitching indentations in the mold together with the stitch pins which create simulated stitches on the molded ball;

SUMMARY OF THE INVENTION

Figure 3:
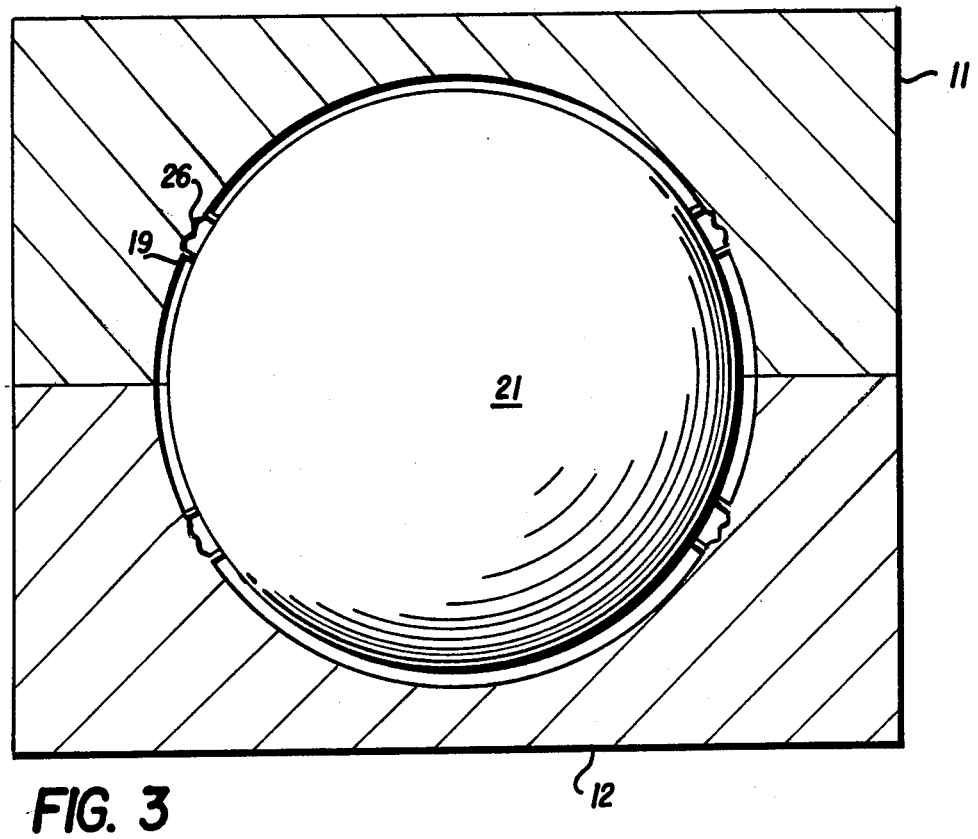
FIG. 3 is a cross-sectional view of the mold with a spherical core within the mold and ready for application of the cover stock to this sphere.

A two-part mold is produced from a master, typically a high quality leather covered top grade softball or baseball, such that each of the hemispheres of the mold has depressions and positive projections which impart a simulated seam, stitching and grain simulation to the cover of a ball being molded. Permanent stitch-hole pins extend outwardly from the stitching projections and depressions in the mold along either side thereof so that simulated stitch holes appear in the resultant molded ball. Accordingly, substantially perfect reproduction of the surface of the master is achieved.

DETAILED DESCRIPTION OF THE INVENTION

Turning now to FIGS. 1 and 2, there is disclosed therein the details of one hemispherical half of a mold used in producing the balls of the present invention.

In making the mold, a standard leather covered ball of the best quality and dimensions (being proud through the pole diameter in order to compensate for the loss in this dimension when the electroform is cut into halves) is used in order to construct a master mold. The first step in producing the mold is to insert metal pins, such as nickel pins, into the ball master prior to any plating process. These nickel pins are not secured within the ball in any manner so that they become an integral part of the finished mold. The mold is then made in any standard fashion such as by electrolitically depositing nickel and copper, or nickel or copper on the surface of the leather ball after the nickel pins are inserted in the stitch holes. After a sufficient thickness of plating is achieved, the assembly is removed from the bath, a keyway is cut in the resultant electroform at the proposed parting line to insure proper registration and is then cut into halves to form the required mold after the master is removed. These mold halves have contained therein the stitch hole pins which had been previously inserted into the master ball. If necessary the stitch hole pins may be cut to assure that they are of the same length. By producing balls from this select master mold and using these balls to make additional molds, the end production product will have uniformity of size and surface configuration superior to any of the existing commercial products.

As can be seen in FIG. 1, there is shown a mold half 11 having a hemispherical cavity 13 which is a female counter part of the depressions and positive projections as produced from the stitching 15 of the ball which is used to create the mold. Input 14 and output 16 provide means for supplying hot and cold liquid to the mold for the heating and cooling thereof. Also indicated are a plurality of stitch hole pins 17 and 19 which extend from the outer extremities of the stitching at the location of the stitch holes of the original ball. FIG. 2 shows in more detail the particular interior of the mold (FIG. 1). As can be seen, detail of the master ball is faithfully reproduced.

As illustrated, the mold is formed so that the stitching pattern is symmetric in the mold with respect to the two halves of the mold. This provides a molded ball wherein the flashline will only cross two sections of simulated stitching, thus reducing the problems of removing such flashline.

Turning to FIG. 3, a cross-sectional view discloses a mold having two hemispherical dies 11 and 12 with a spherical core 21 in place within the die. For clarity purposes, the input and output connections are not shown. Stitch hole pins 19 extend substantially to spherical core 21 and the space between the inner most surface of each die and the core permits room for cover stock. Also shown are mold depressions 26 which assist in creating the stitching simulation.

While there are many options for molding leather-like material upon the core to produce this subject ball, the preferred method is to slush cast and gel a vinyl plastisol cover into the open mold, insert the preferably pre-cemented center, close the mold, fuse the vinyl, then cool it so that the final product can be removed from the opened mold.

Other methods of making the ball are molding of hemispherical shells that have a thickness of about 0.040 to about 0.070 inches with preferred thickness being 0.060 inches that are then placed around the core; the assembly is then placed into the electroform mold; the mold is closed under low pressure and heated to distribute the cover around the core and to accept the texture and definition of the inside of the cavity. It is then cooled and the finished part is removed. Many materials such as vinyl, urethane or other applicable polymers, either by themselves or in mixtures or as alloys, may be used as discussed above.

A further method for forming the cover around the core is to inject any of the aforementioned polymers into a closed mold around a previously formed center. Yet another option is to use the Rim technique by injecting the liquid urethane into a mold having a metal core to form the cover. The mold is opened, the metal core is removed, the mold is closed and the center compound is injected into the void to form the center.

In the case of slush molding, or any other applicable method of depositing on the walls of the mold cover stock material and then placing the core into the cavity, closing the cavity and fusing or curing the cover material in place onto the center, the stitch hole pins may aid in centrally locating the core to insure uniform distribution of the cover.

While a two-piece ball is preferred, it is to be understood that unitary one-piece balls can be made by injection of a desired material so as to completely fill the mold without the use of a cover material.

It should be noted that permanent stitch-hole pins are absolutely necessary if one chooses to injection mold the cover onto the center, which is possible and is particularly of interest in molding baseballs, since the centers in this instance are significantly hard enough to be properly supported and held in position by the pins.

This process of molding the balls using stitch-hole pins is unique in that they effectively create a multitude of serious undercuts that would appear to interfere and prevent removal of the final molded product. It has been determined, however, that the finished molded ball can be removed without difficulty and without damage to the cover. In the case of the preferred embodiment, the vinyl covered balls can be removed most easily at 170° to 185° F.

Figure 4:
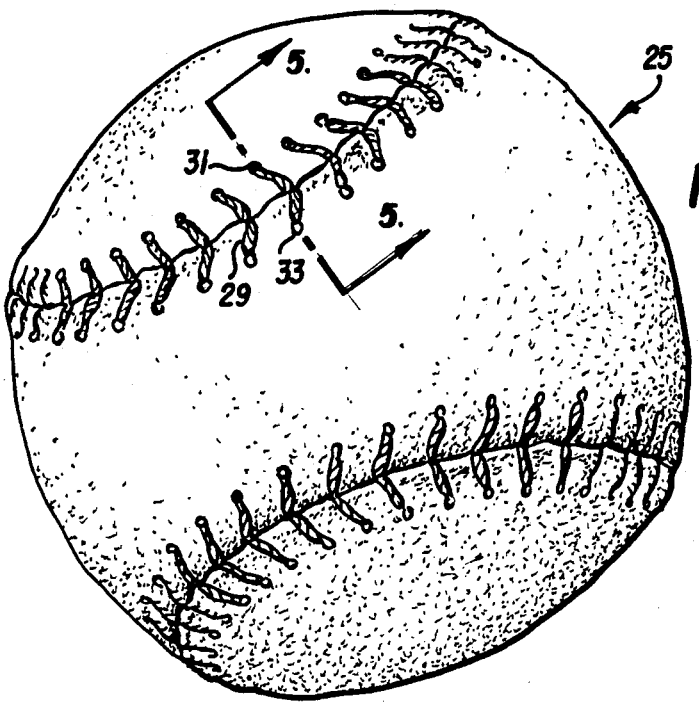
FIG. 4 discloses a resultant ball produced by the mold of FIGS. 1 through 3.
Figure 5:
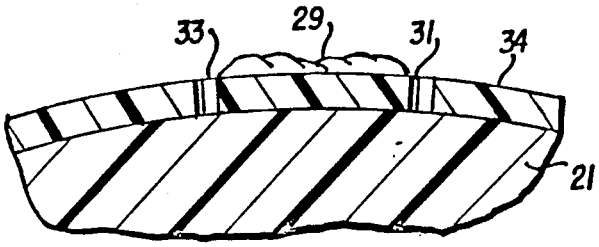
FIG. 5 is a partial sectional view taken through lines 5—5 of FIG. 4.
Figure 6:
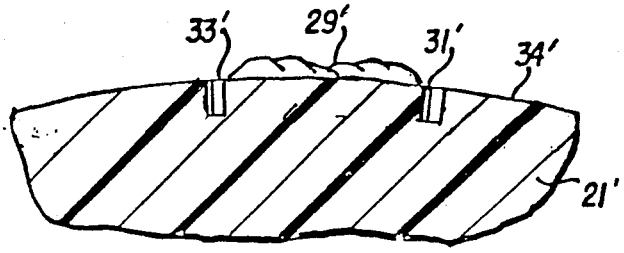
FIG. 6 is a sectional view of a modification of FIG. 5.

FIG. 4 is a plan view of a finished ball 25 produced by the techniques and the mold discussed above. The cover of the ball includes simulated stitches 29 and stitch holes 31 and 33 which are remarkably similar to that of a leather covered and stitched ball. Details of the cover, stitches and stitch holes are more clearly illustrated in the enlarged partial sectional view of FIG. 5, wherein it can be seen that the stitch holes extend through the cover to core 21, which is the obvious result of using the mold of FIGS. 1–3. FIG. 6 illustrates a one-piece unitary ball 21' having no separate cover material and made in the same mold such that simulated stitches stich holes having the same depth as illustrated in FIG. 5 create a substantially perfect reproduction of a leather-covered and stitched ball. The present invention, including the method of making the electroform cavity halves that faithfully reproduce without any significant shrinkage or major loss of detail of the existing leather covered product, permits production of a molded product that is almost indistinguishable from the hand stitched leather product. Superior abrasion resistance is obtained by using a vinyl, an acrylic or urethane coating that has a leather odorant to further promote duplication of the hand stitched leather product in all respects.

The above description and associated drawings are descriptive only and are not intended to limit the invention in any respect, the scope of which is to be limited only by the following claims.

What is claimed is:

1. A playing ball comprising a substantially solid spherical core;

a polymer cover material applied about said core;

simulated stitching having protrusions and indentations integral with and of the same material as the outer surface of said cover material; and a multiplicity of simulated stitch holes adjacent the outer edges of said stitching, said simulated stitch holes extending through said cover material to said spherical core to simulate the depth of the stitching holes of a standard stitched leather covered ball.

* * * * *